United States Patent [19]

Hawkins

[11] 4,299,306

[45] Nov. 10, 1981

[54] EXTENSION LADDER LOCK

[75] Inventor: Harvey G. Hawkins, Salem, Ind.

[73] Assignee: Emerson Electric Co., St. Louis, Mo.

[21] Appl. No.: 101,150

[22] Filed: Dec. 7, 1979

[51] Int. Cl.[3] ..... E06C 7/06

[52] U.S. Cl. ..... 182/210

[58] Field of Search ..... 182/210, 211, 209, 208, 182/207

[56] References Cited

U.S. PATENT DOCUMENTS

| | | | |
|---|---|---|---|
| 457,805 | 8/1891 | Whittington | 182/210 |
| 478,384 | 7/1892 | Weston | 182/211 |
| 556,831 | 3/1896 | Moulton | 182/210 |
| 679,385 | 7/1901 | Klemme et al. | 182/210 |
| 1,059,340 | 4/1913 | Boyer | 182/210 |
| 1,113,413 | 10/1914 | Conabee | 182/211 |
| 1,170,395 | 2/1916 | Beatty | 182/210 |
| 1,445,848 | 2/1923 | Ridings | 182/210 |
| 2,388,415 | 11/1945 | John | 182/210 |
| 3,768,594 | 10/1973 | Kramer | 182/210 |

FOREIGN PATENT DOCUMENTS

| | | | |
|---|---|---|---|
| 19376 | of 1911 | United Kingdom | 182/210 |
| 134478 | 11/1919 | United Kingdom | 182/210 |
| 1053619 | 1/1967 | United Kingdom | 182/210 |

*Primary Examiner*—Reinaldo P. Machado

*Attorney, Agent, or Firm*—Polster, Polster and Lucchesi

[57] ABSTRACT

A lock for an extension ladder of the type having a movable frame section and a stationary frame section includes a first member forming a guideway which has an open end for receiving stations of the ladder and a second member forming an arm for guiding the lock past the stations of the ladder when the ladder is being extended or retracted. The first member has an elongated projection extending downwardly at the open end of the guideway for containing the stations within the guideway. A pivotal connection between the first member and the second member is located to a first side of a center line of the lock and the projection is located to a second side of the center line when the lock is freely hanging. When the open end of the guideway is closed by the second member, the tip of the projection, a cam surface of the second member, and the pivotal connection are generally in the same plane which forms an angle of 90° or less with the projection. The lock is swingably connected to the movable frame section, and the pivotal connection between the first member and the second member is located along a lower portion of the first member so that it lies generally above a horizontal plane which bisects a station of the stationary frame section and is coincidentally tangent to the tip of the projection.

13 Claims, 4 Drawing Figures

EXTENSION LADDER LOCK

The present invention relates to locks for engaging the rungs or stations of a ladder of the type having movable and stationary frame sections to hold the movable frame section in a selected longitudinal position with respect to the stationary frame section. More particularly, the present invention includes improvements in a locking mechanism for an extension ladder which reduce the motion of the locking mechanism and thereby produce smoother operation of the extension ladder.

Many mechanisms for engaging the rungs or stations of an extension ladder to lock a movable frame section of the ladder in a selected position with respect to a stationary frame section are well-known to those skilled in the art. Exemplary of such extension ladder locks are the following U.S. Pat. Nos. 556,830; 457,805; 478,384; 1,059,340; 1,170,395; 1,445,848; and 2,388,415. Of these patents, 457,805; 1,445,848; and 2,388,415 are most representative of the structure and problems associated with conventional extension ladder locks.

Anyone who has ever operated an extension ladder can attest to one common problem associated with conventional extension ladder locks. This problem is the gouging of the rungs or stations of the stationary frame section by the finger or hook which closes the guideway opening in the lock to guide the lock past the rungs or stations of the stationary frame section of the ladder when the movable frame section is being moved to extend the ladder. The gouging of the rungs or stations of the stationary frame section by the finger or hook occurs as a result of swinging of the lock as it is cammed past the rungs or stations and many times results in the movable frame section of the ladder being hung up as it is being extended. This erratic operation of conventional extension ladder locks is due to the design of such locks.

Accordingly, in one broad concept, it is a feature of the present invention to improve the construction of extension ladder locks so as to combine functions and thereby reduce the motion of the lock to produce a smoother operation and eliminate gouging of the rungs or stations of the stationary frame section.

It is an additional feature of the present invention to provide an extension ladder lock having an arm for guiding the lock past rungs or stations of the ladder which is pivotally connected to a first member of the lock at a location with respect to the first member that improves the operation of the lock. Operation of the lock is further improved by the shape of the arm. In one embodiment, the arm is triangular and includes two angularly disposed cam surfaces for guiding the lock past the rungs or stations of the ladder.

In accordance with the present invention, the pivotal connection between the first member and the guide arm of the lock is located to a first side of a center line of the lock and a projection extending downwardly from the first member is located to a second side of the center line when the lock is freely hanging.

It is a further feature of the present invention to provide an extension ladder lock as described above wherein the first member forms a guideway having an open end for receiving the rungs of the ladder and a downwardly extending projection for containing the rungs within the guideway. In one embodiment, the pivotal connection between the first member and the guide arm is located with respect to a lower portion of the first member so that when the open end of the guideway is closed by the arm, the tip of the projection, one cam surface of the arm, and the pivotal connection are generally in the same plane. Accordingly, the cam surface of the arm and the downwardly extending projection generally form an angle with respect to each other which is equal to or less than 90°.

Further according to the present invention, in an extension ladder including the locking mechanism described above, the pivotal connection between the first member and the guide arm is located on the lower portion of the first member so that it lies generally above a horizontal plane which bisects a rung or station of the stationary frame section and is coincidentally tangent to the tip of the projection.

In accordance with the features described above, the tip of the guide arm will always meet a rung or station of the stationary frame section at a point which is below the pivot connection of the first member and the guide arm. Accordingly, the tip of the guide arm is swung away from the rung or station of the stationary frame section of the ladder by gravity to thereby prevent gouging of the rung or station by the guide arm.

While some of the features of the present invention have been described above, other features and advantages of the present invention will be apparent from the following detailed description of an embodiment thereof, which description should be considered in conjunction with the drawings, in which.

Figure 1:
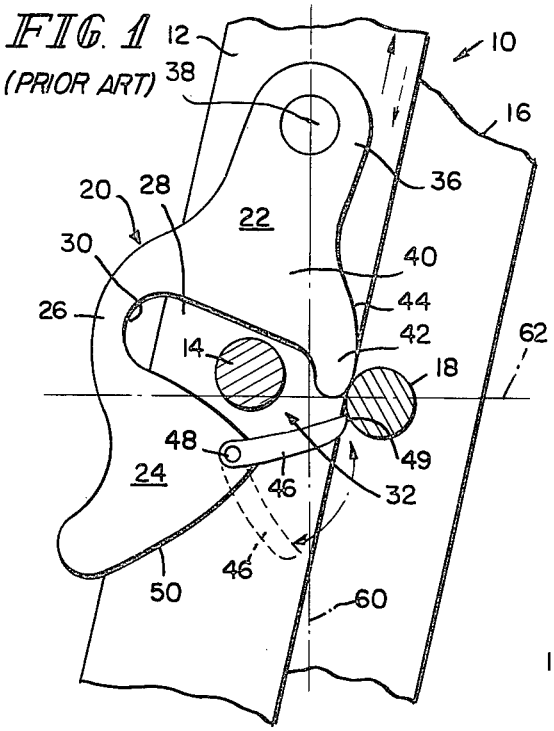
FIG. 1 (PRIOR ART)
FIG. 1 is a partly sectioned and fragmentary view of an extension ladder illustrating an operable position of a conventional locking mechanism.

Illustrated in FIG. 1, as prior art, is a conventional extension ladder lock of the same general nature as those disclosed in the U.S. Pat. Nos. 457,805; 1,445,848; and 2,388,415 previously referenced. Shown generally in FIG. 1 is a partially sectioned and fragmentary portion of an extension ladder 10 which typically includes a movable upper frame section 12 having a plurality of rungs or stations 14 and a stationary lower frame section 16 also including a plurality of rungs or stations 18. In the operation of a conventional extension ladder 10, the upper frame section 12 is moved longitudinally with respect to the lower frame section 16, as illustrated by the arrows, to either extend or retract the movable upper frame section 12. Once the upper frame section 12 has been moved to a desired location, a locking mechanism 20 engages the rungs or stations 14, 18 of each of the frame sections 12, 16 to hold the upper frame section 12 in a selected position relative to the lower frame section 16.

Continuing to refer to FIG. 1, the conventional extension ladder lock 20 includes an upper portion 22 and a lower portion 24 joined by an intermediate portion 26 which are usually formed as a single unit from a metal such as aluminum. The portions 22, 24, 26 form a C-shaped elongated notch 28 having a closed end 30 and an open end 32. The notch 28 provides a guideway adapted to receive and contain rungs or stations 14, 18 of the upper ladder and lower ladder sections 12, 16, respectively. The upper portion 22 of the lock 20 includes a narrow upper end 36 having means 38 provided therein for pivotally connecting the lock 20 to the upper ladder section 12. The narrow upper end 36 gradually widens to symmetrically produce a lower end 40 of the upper portion 22. Extending downwardly from one side of the lower end 40 is a projection 42 for containing the rungs 14, 18 within the guideway of the notch 28. Also formed by the lower end 40 is an angularly disposed upper cam surface 44 to guide the lock past the rungs or stations 18 of the lower frame section 16 as the upper frame section 12 is extended (moved in the direction of the solid arrow).

A guide tongue 46 is pivotally connected to the lower portion 24 of the lock 20 at a point 48 so that the tongue 46 is swingable in the directions of the arrow. The tongue 46 includes a tip 49 which in operation is intended to engage the projection 42 to close the guideway of the notch 28 as the lock 20 passes the rungs or stations 18 of the lower frame sections 16 during the retraction of the upper frame section 12 (moved in the direction of the broken arrow). Angularly disposed along the lower portion 24 of the lock 20 is a lower cam surface 50 which guides the lock 20 past the rungs or stations 18 of the lower frame section 16 as the upper frame section 12 is retracted. It should be noted that the lower cam surface 50 and the tongue 46 function separately to guide the lock 20 past the rungs or stations 18 of the lower frame section 16.

For purposes of discussing the design and structure of the conventional locking mechanism 20, a vertical line 60 has been drawn through the pivot connection 38 to the upper ladder section 12 and a horizontal line 62 has been drawn perpendicular to the vertical line 60 and tangent to the tip of the downwardly extending projection 42. Importantly, three structural features of the conventional locking mechanism 20 which affect the operation of the locking mechanism 20 should be noted. First, the tongue 46 meets or engages the tip of the projection 42 at an angle greater than 90°. Second, as best illustrated in FIG. 1, the pivotal connection 48 is located below the horizontal line 62 in each instance where the horizontal line 62, in addition to being tangent to the tip of the projection 42, also bisects a rung or station 18 of the lower frame section 16. Furthermore, although not specifically illustrated in FIG. 1, it can be appreciated that when the conventional locking mechanism 20 is freely hanging from its pivot point 38, the pivot connection 48 between the tongue 46 and the lower portion 24 will be located to the same side of the center or vertical line 60 as the downwardly extending projection 42. These structural features, among other things, cause the angle between the projection 42 and the tongue 46 to be greater than 90°.

Accordingly, as the upper frame section 12 is extended, the rungs or stations 18 of the lower frame section 16 have a tendency to be captured between the downwardly extending projection and the tongue 46, causing the upper frame section 12 to be periodically stopped. The gouging of the rungs or stations 18 by the tongue 46 causes erratic operation of the locking mechanism 20.

Figure 2:
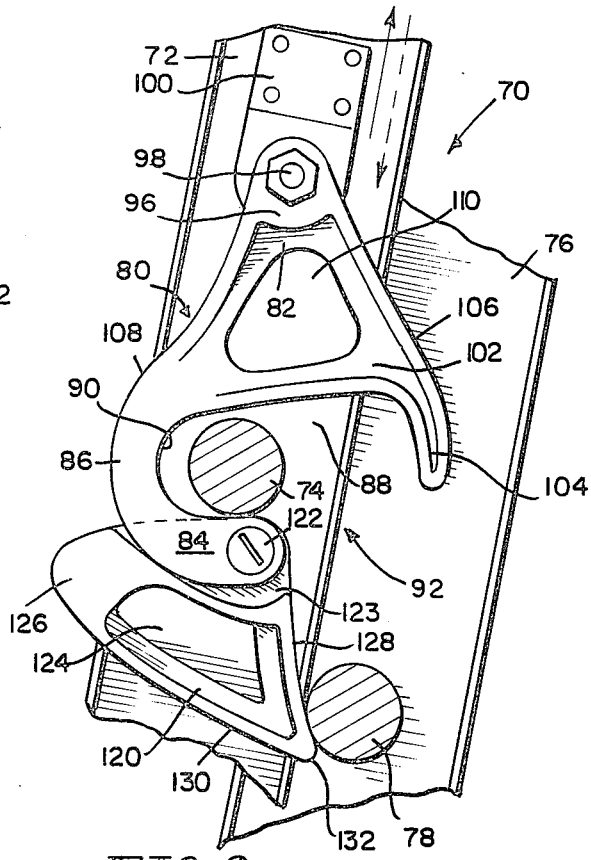
FIG. 2 is a partially sectioned and fragmentary view of an extension ladder illustrating one operable position of a locking mechanism constructed in accordance with the present invention.
Figure 4:
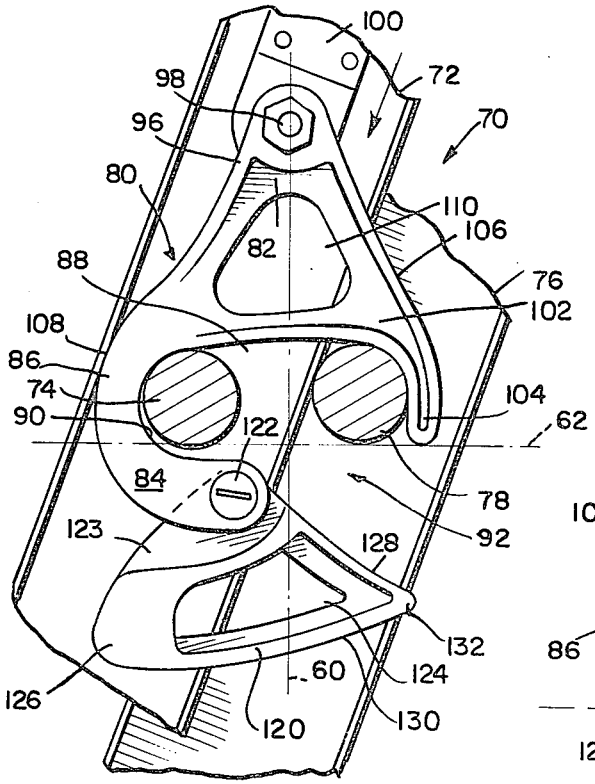
FIG. 4 is a partially sectioned and fragmentary view of an extension ladder illustrating yet another operable position of the locking mechanism of FIGS. 2 and 3.
Figure 3:
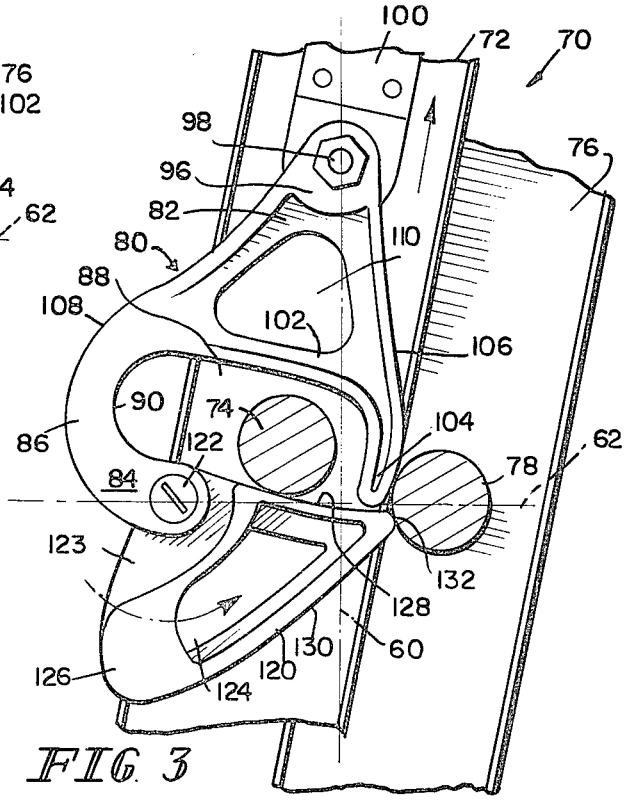
FIG. 3 is a partially sectioned and fragmentary view of an extension ladder illustrating another operable position of the locking mechanism of FIG. 2.

Illustrated in FIGS. 2–4 is a locking mechanism constructed in accordance with the present invention which includes structural features for improving the operation of the locking mechanism and extension ladder. Throughout the several views shown in FIGS. 2–4, corresponding reference characters are intended to indicate corresponding parts of the locking mechanism of the present invention.

Referring now to FIGS. 2–4, a partially sectioned fragment of a conventional extension ladder 70 of the type previously described is shown with the locking mechanism of the present invention in three different operable positions. The extension ladder 70 illustrated in FIGS. 2–4 includes a movable upper frame section 72 including a plurality of rungs or stations 74 which is longitudinally extendable or retractable in the directions of the arrows with respect to a stationary lower frame section 76 which also includes a plurality of rungs or stations 78.

The improved locking mechanism 80 of the present invention includes a first member having a generally triangular upper portion 82, a lower portion 84 formed generally like a curved finger and projecting downward from the upper portion 82, and an intermediate portion 86 interposed between and connecting the upper portion 82 and the lower portion 84. The upper, lower, and intermediate portions 82, 84, 86, respectively, comprise the first member of the locking mechanism 80 and in combination form a C-shaped notch 88 providing an elongated guideway adapted to receive and contain the rungs 74, 78. The guideway 88 has a closed end 90 and an open end 92 for receiving the rungs 74, 78. While the locking mechanism 80 will usually engage the rungs of the ladder, it can be appreciated that other means forming ladder stations may be engaged by the lock to secure the movable frame in a position relative to the stationary frame section.

A narrow upper end 96 of the upper portion 82 includes means 98 for pivotally connecting the locking mechanism 80 to the movable upper frame section 72. In one embodiment, the pivotal connecting means 98 includes a mounting post which, in cooperation with a mounting plate 100 fixed to the upper frame section 72, allows the locking mechanism 80 to freely swing about the pivotal connection 98.

As best illustrated in FIGS. 2–4, the upper portion 82 of the first member widens downwardly to form an expanded lower end 102. Extending downwardly from one side of the lower end 102 of the upper portion 82 is an elongated projection 104 for containing the rungs 74, 78 within the guideway 88. As will become apparent from the further description of the lock 80, the projection 104 must have a length substantially equivalent to the cross-sectional dimension of (i.e., the heightwise distance between the opposing surfaces defining) the C-shaped notch or guideway 88. An angularly disposed cam surface 106 cooperates with the downwardly extending projection 104 to guide the rungs or stations 78 of the lower frame section 76 past the guideway 88 when the movable upper frame section 72 is being extended in the direction of the solid arrow. Importantly, it should be noted that the triangular upper portion 82 is unsymmetrical, having one side 108 in proximity to the lower and intermediate portions 84, 86 projecting outwardly to locate the lower portion 84 away from the projection 104 and enlarge the open end 92 of the guideway 88. As will be described in more detail hereinafter, this feature allows any connection made to the lower portion 84 to be located on a side opposite to the downwardly extending projection 104 from a vertical center line 60 running through the pivot connection 98. In order to reduce the overall weight of the locking mechanism 80, the upper portion 82 also includes a punched out area 110.

Pivotally connected to the lower portion 84 of the first member of the locking mechanism 80 is a second member forming a guide arm 120 which is also generally triangular-shaped. As can best be seen in FIGS. 2–4, the guide arm 120 has the general shape of an equilateral triangle. The arm 120 and the lower portion 84 of the first member are connected by a pivot post 122 located in one embodiment at the end of the lower portion 84. The arm 120 includes a recessed area 123 of approximately one-half of the thickness of the arm 120 for receiving the lower portion 84 of the first member. Although not shown, it will be understood that the lower portion 84 is also recessed to mate with the recessed area 123 of the arm 120 so that the front surfaces of the lower portion 84 and the arm 120 are generally in the same plane and the back surfaces of the lower portion 84 and the arm 120 are also generally in the same plane. According to the present invention, the pivot connection 122 may be located anywhere along the lower or intermediate portions 84, 86 of the first member so that the angle between the arm 120 and the downwardly extending projection 104 when the arm 120 meets or engages the projection 104 to close the opening 92 will be 90° or less.

The arm 120 also includes a punched-out area 124 to reduce the overall weight of the locking mechanism 80. Furthermore, the arm 120 includes an enlarged weighted area 126 opposite to a first cam surface 128 and a second cam surface 130. The enlarged weighted area 126 provides counterbalancing of the locking mechanism 80. As can best be seen in FIG. 3, the apex 132 of the angle formed by the two cam surfaces 128, 130 extends slightly beyond the downwardly extending projection 104 when the arm 120 meets or engages the projection 104.

Referring specifically now to FIG. 2, the locking mechanism 80 is illustrated in one operable position. In the position illustrated, the movable upper frame section 72 is being extended in the direction of the solid arrow with respect to the stationary lower frame section 76. It should be noted that the cam surface 106 engages each rung or station 78 to guide the locking mechanism 80 past such station 78 as the movable upper frame section 72 is being extended upwardly. As can also be seen in FIG. 2, the cam surface 128 of the arm 120 guides the locking mechanism 80 past those rungs or stations 78 which have already been guided by the cam surface 106. Accordingly, it can be appreciated that the arm 120 serves two functions. In addition to closing the opening 92 when the upper ladder section 72 is being retracted in the direction of the broken arrow, the arm 120 also serves to guide or cam the stations 78 of the stationary lower frame section 76 past the locking mechanism 80. In contrast to the conventional locking mechanism 20 wherein the tongue 46 and a cam surface 50 of the lower portion 24 separately perform these functions, both functions are accomplished by the single arm 120 of the locking mechanism 80 of the present invention. This feature of the locking mechanism 80 improves the operation of the lock 80, particularly during the extension of the ladder 70. As illustrated in FIG. 1, when the projection 42 of the conventional lock 20 passes a station 18, the station 18 engages the tongue 46 in the position shown by the broken lines and then the cam surface 50. In the lock 80 of the present invention, the station 78 engages only the cam surface 128 of the arm 120 after it passes the projection 104, as best illustrated by the operable position shown in FIG. 2.

Referring now to FIG. 3, and comparing the operable position of the lock 80 in FIG. 3 to the operable position of the conventional lock 20 in FIG. 2, it can be seen that when the horizontal line 62 bisects a rung or station 78 of the stationary lower frame section 76 and is also tangent to the tip of the downwardly extending projection 104, the pivotal connection 122 between the lower portion 84 of the first member and the arm 120 will always be above the horizontal line 62. In contrast, FIG. 1, which illustrates the same operable position of a conventional lock 20, shows that the pivotal connection 48 between the lower portion 24 and the tongue 46 will always be below the horizontal line 62 when the line 62 bisects a rung or station 18 of the stationary lower frame section 16 and is tangent to the tip of the downwardly extending projection 42. It should be understood that the operable positions illustrated in FIGS. 1 and 3 will only occur when the movable upper frame section 12, 72 is being rapidly extended with respect to the stationary frame section 16, 76 so that the camming action of the locks 20, 80 causes the tongue 46 or arm 120 to swing upwardly in the direction of the arrows in FIGS. 1 and 3. In the conventional lock 20, the tongue 46 has a tendency to gouge the rungs or stations 18 and capture the rung or station 18 between the tip 49 of the tongue 46 and the downwardly extending projection 42. As illustrated in FIG. 3, the construction of the upper, intermediate and lower portions 82, 86, and 84 of the first member and of the arm 120, in combination with the fact that the pivot connection 122 between the lower portion 84 and arm 120 is located on a side of the vertical center line 60 which is opposed to the location of the downwardly extending projection 104, prevents the apex 132 of the arm 120 from gouging the rungs or stations 78 of the stationary lower frame section 76 when the upper frame section 72 is being extended.

Continuing to refer to FIG. 3, in one embodiment, the pivotal connection 122 is located at the end of the lower portion 84, whereby the pivotal connection 122, the cam surface 128, and the tip of the downwardly extending projection 104 are all located in substantially the same plane when the cam surface 128 engages the tip of the projection 104. In this embodiment, the angle formed by the cam surface 128 and the downwardly extending projection 104 is substantially 90°. It will be appreciated that if the pivot connection 122 is relocated on the lower portion 84 in closer proximity to the intermediate portion 86 of the first member, the angle between the cam surface 128 and the projection 104 will decrease and therefore be less than 90°.

Referring now particularly to FIG. 4, the locking mechanism 80 is illustrated in its operable position of engaging both rungs 74 and 78 to secure the upper frame sections 72 in a selected position in relation to the lower frame section 76. As shown in FIG. 4, the lock 80 is in a generally free-hanging position, and therefore FIG. 4 best illustrates the fact that the pivotal connection 122 between the lower portion 84 of the first member and the arm 120 is always located on an opposite side of the vertical center line 60 from the downwardly extending projection 104.

What is claimed is:

1. A lock for an extension ladder having a stationary frame section and a movable frame section, each of said stationary and movable sections having fixed rungs or stations, said lock comprising a first member forming a guideway embracing a fixed station of said movable section and having an open end for receiving stations of the fixed frame section of said ladder, the first member including a downwardly extending projection for containing the stations within the guideway, means for connecting the first member to said movable frame section of the ladder, a second member forming an arm for guiding the lock past the stations of the stationary frame section of said ladder, and a pivotal connection between the first member and the second member, the connection being located to a first side of a center line of the lock and the projection being located to a second side of the center line when the lock is freely hanging from the means connecting the first member to the frame section, the projection and the pivotal connection further being so located that when the said second member is in guiding position and a horizontal line bisects a rung or station of said ladder and is also tangent to the free tip of said projection, the said pivotal connection is always above the said horizontal line.

2. The apparatus as recited in claim 1 wherein the second member and the projection form an angle therebetween which is at most 90° when the open end of the guideway is closed by the second member.

3. The apparatus as recited in claim 1 wherein the pivotal connection, the tip of the projection, and a surface of the second member are generally in the same plane when the open end of the guideway is closed by the second member.

4. The apparatus as recited in claim 1 wherein the guideway is elongated and C-shaped and the length of the downwardly extending projection is generally equal to the cross-sectional dimension of the guideway.

5. The apparatus as recited in claim 1 wherein the first member includes an unsymmetrical upper portion and a lower portion forming a finger extending and curving downwardly from the upper portion, the upper portion protruding outwardly along one side to form the lower portion.

6. The apparatus as recited in claim 5 wherein the pivotal connection between the first member and the second member is located in the lower portion of the first member.

7. The apparatus as recited in claim 6 wherein the arm is generally shaped in the form of an equilateral triangle having two sides forming angularly disposed cam surfaces for guiding the lock past the stations of the ladder.

8. The apparatus as recited in claim 7 wherein the arm includes a weighted area opposite an angle formed by the intersection of the two cam surfaces for counterbalancing the first member.

9. The apparatus as recited in claim 1 wherein the first and second members include punched-out areas for lessening the overall weight.

10. An extension ladder, comprising two frame sections, each having a plurality of stations, a first frame section being movable longitudinally with respect to a second frame section, and means for locking the first frame section in a desired position relative to the second frame section wherein the locking means includes a first member having upper and lower portions forming a guideway with an open end for receiving the stations, a projection extending downwardly from the upper portion for capturing the stations within the guideway, first means for pivotally connecting the first member to the first frame section, a second member including first and second angularly disposed cam surfaces for guiding the locking means past the stations of the second frame, and second means for pivotally connecting the second member to the lower portion of the first member, the second connecting means being located on the lower portion of the first member so that it lies generally above a horizontal plane which bisects a station of the second frame section and is tangent to the tip of the projection and to a surface of the said second member contiguous said tip.

11. The apparatus as recited in claim 10 wherein the second member and the projection form an angle therebetween which is at most 90°.

12. The apparatus as recited in claim 11 wherein the second connecting means and the projection are located on opposed sides of a vertical center line of the locking means when it is freely hanging from the first connecting means.

13. The apparatus as recited in claim 12 wherein the guideway is elongated and C-shaped and the length of the downwardly extending projection is generally equal to the cross-sectional dimension of the guideway.

* * * * *